US008981665B1

(12) United States Patent
Hamburgen et al.

(10) Patent No.: US 8,981,665 B1
(45) Date of Patent: Mar. 17, 2015

(54) COLOR SHIFTING PUMPED-PHOSPHOR LIGHT EMITTING DIODE LIGHT SOURCES VIA MODULATION OF CURRENT PULSES

(75) Inventors: William Hamburgen, Palo Alto, CA (US); Ken Foo, Santa Clara, CA (US)

(73) Assignee: Google Inc., Mountain View, CA (US)

( * ) Notice: Subject to any disclaimer, the term of this patent is extended or adjusted under 35 U.S.C. 154(b) by 516 days.

(21) Appl. No.: 13/156,110

(22) Filed: Jun. 8, 2011

(51) Int. Cl.
*H05B 37/02* (2006.01)

(52) U.S. Cl.
USPC ..... 315/291; 315/363

(58) Field of Classification Search
USPC ..... 315/291, 169.3; 345/44, 82; 257/78–102
See application file for complete search history.

(56) References Cited

U.S. PATENT DOCUMENTS

| | | | | |
|---|---|---|---|---|
| 6,628,249 | B1 * | 9/2003 | Kamikawa et al. | 345/44 |
| 2003/0132721 | A1 * | 7/2003 | Jacobs et al. | 315/291 |
| 2007/0120496 | A1 * | 5/2007 | Shimizu et al. | 315/169.3 |
| 2011/0037388 | A1 * | 2/2011 | Lou et al. | 315/35 |

* cited by examiner

*Primary Examiner* — Douglas W Owens
*Assistant Examiner* — Jonathan Cooper
(74) *Attorney, Agent, or Firm* — Brake Hughes Bellermann LLP

(57) ABSTRACT

A light source can include an LED configured to emit light having a spectrum of first wavelengths when provided with electrical current, a pumped material configured to absorb at least some of the light emitted by the LED and to emit light having a spectrum of second wavelengths, a power supply configured to provide a series of electrical current pulses to the LED, and a current controller configured to control a time-averaged chromaticity coordinate of a combination of light emitted from the LED and the pumped material by controlling the series of current pulses provided to the LED.

20 Claims, 7 Drawing Sheets

COLOR SHIFTING PUMPED-PHOSPHOR LIGHT EMITTING DIODE LIGHT SOURCES VIA MODULATION OF CURRENT PULSES

TECHNICAL FIELD

This description to relates light emitting diode (LED) sources of white light and, in particular, to color shifting of pumped-phosphor light emitting diodes via modulation of current pulses.

BACKGROUND

Light emitting diodes (LEDs) provide a relatively efficient and inexpensive source of light. However, LEDs generally produce light over only a narrow range of visible wavelengths. Thus, to produce white light, the light from multiple LEDs that produce different wavelengths of light can be combined, such that the combination of outputs appears white to a person. Alternatively, the generally-monochromatic light output from an LED can used to pump another light source (e.g., a phosphor material) that absorbs the narrowband light from the LED and emits another, typically broader, spectrum of light, such that the combined spectrum of the LED and the other light source can appear white to a person. The color of light emitted by the LED and the color of light emitted by the pumped light source generally are complementary to each other, so that when the two colors mixed white light results. For example, a blue LED may be used to pump a light source (e.g., a phosphor material) that emits yellow light, because blue and yellow are complementary colors.

LEDs that are used to produce white light can be used to provide backlighting for a liquid crystal display (LCD) device.

SUMMARY

In a general aspect, a method of controlling a color of light from a light that includes an LED and a pumped material includes providing a series of current pulses to the LED, with the LED providing a series of light pulses in response to the provided series of current pulses. The series of light pulses provided by the LED is directed to the pumped material, where the pumped material is adapted to absorb at least some of the directed light and to emit light having a spectrum of second wavelengths. A time-averaged chromaticity coordinate of light emitted from the light source is controlled by controlling the series of current pulses, where the emitted light includes a combination of the light having the spectrum of second wavelengths and light from the series of light pulses provided by the LED.

Implementations can include one or more of the following features. For example, a time-averaged luminosity of the light emitted from the light source can be maintained while the time-averaged chromaticity coordinate is controlled. Controlling the series of current pulses can include controlling a duration of the current pulses in the series of current pulses. Controlling the series of current pulses can include controlling a frequency at which the current pulses are provided to the LED. A frequency at which the current pulses are provided to the LED can be greater than 5 Hz. Controlling the series of current pulses can include controlling an amplitude of the current pulses. The time-averaged chromaticity coordinate of light emitted from the light source can be additionally controlled by controlling a temperature of the LED. The time-averaged chromaticity coordinate of light emitted from the light source can be averaged over a time of more than one second. A peak emission wavelength of the light pulses provided by the LED can be between 440 nm and 510 nm. The spectrum of second wavelengths can have a peak emission wavelength of between 570 nm and 610 nm. The LED can be at least partially encapsulated by the pumped material. The time-averaged chromaticity coordinate produced by the light source at a first time can be changed to a different time-averaged chromaticity coordinate produced at a second time by controlling the series of current pulses, while maintaining a time-averaged luminosity of the light emitted from the light source while the time-averaged chromaticity coordinate is controlled. The light emitted from the light source can be provided to a light guide panel, where the light guide panel is coupled to a computer-controlled display device and is configured to transmit the emitted light to the computer controlled display device.

In another general aspect, a light source can include an LED configured to emit light having a spectrum of first wavelengths when provided with electrical current, a pumped material configured to absorb at least some of the light emitted by the LED and to emit light having a spectrum of second wavelengths, a power supply configured to provide a series of electrical current pulses to the LED, and a current controller configured to control a time-averaged chromaticity coordinate of a combination of light emitted from the LED and the pumped material by controlling the series of current pulses provided to the LED.

Implementations can include one or more of the following features. For example, the current controller can be further configured to maintain a time-averaged luminosity of the combination of light while the time-averaged chromaticity coordinate is controlled. Controlling the series of current pulses can includes controlling a duration of the current pulses in the series of current pulses. Controlling the series of current pulses can include controlling a frequency at which the current pulses are provided to the LED. Controlling the series of current pulses can include controlling an amplitude of the current pulses. The time-averaged chromaticity coordinate of light emitted from the light source can be averaged over a time of more than one second. A peak emission wavelength of the light emitted by the LED can be between 440 nm and 510 nm. The spectrum of second wavelengths can have a peak emission wavelength of between 570 nm and 610 nm. The LED can be at least partially encapsulated by the pumped material.

In another general aspect, a system includes an LED configured to emit light having a spectrum of first wavelengths when provided with electrical current, a pumped material configured to absorb at least some of the light emitted by the LED and to emit light having a spectrum of second wavelengths, a power supply configured to provide a series of electrical current pulses to the LED, a current controller configured to control a time-averaged chromaticity coordinate of a combination of light emitted from the LED and the pumped material by controlling the series of current pulses provided to the LED, a computer-controlled display device, a light guide panel configured to receive the combination of light and to transmit the emitted light to the computer controlled display device.

DETAILED DESCRIPTION

Light emitting diodes (LEDs) emit light when provided with electrical current. LEDs generally emit light over a relatively narrow range wavelengths, but LEDs can be used to generate a broad-spectrum of light that can appear white to a user when combined with materials that absorb light from the LED and that emit a spectrum of wavelengths different from the LED's spectrum. For example, phosphor materials can be used to absorb light from an LED and, in response to the absorbed light, to emit a relatively broad-spectrum of light. For example, in one implementation, the native LED spectrum can have a peak intensity in a blue portion of the visible spectrum, and the spectrum of light emitted from the phosphor material, when pumped by the LED, can have a peak intensity in a green or yellow portion of the visible spectrum. The combined spectrum of the light emitted from the phosphor materials and the light from the LED that passes through the phosphor material without absorption can appear white to a user. Of course, the relative intensities of the native LED spectrum of the spectrum of the phosphor determine the color of the light perceived by a user. The combined outputs of the native LED and the pumped material can have an x, y chromaticity coordinate that is close to the chromaticity coordinate of the white point of a standard red, green, blue color space. For example, the CIE1931 x, y chromaticity coordinate of the combined output of the different LEDs can be x=0.26-0.32 and y=0.28-0.34.

As described in more detail below, the spectrum of light emitted from an LED and from material pumped by an LED can be affected by the current that is applied to the LED. For example, the amount of current applied to the LED can shift the spectrum of emitted light in a color space. Therefore, by controlling the current that is applied to the LED, the color or chromaticity coordinate of light emitted from the light source that includes the LED in the pumped material can be controlled. In some implementations, the color can be controlled while maintaining a total luminosity of the light source.

Figure 1:
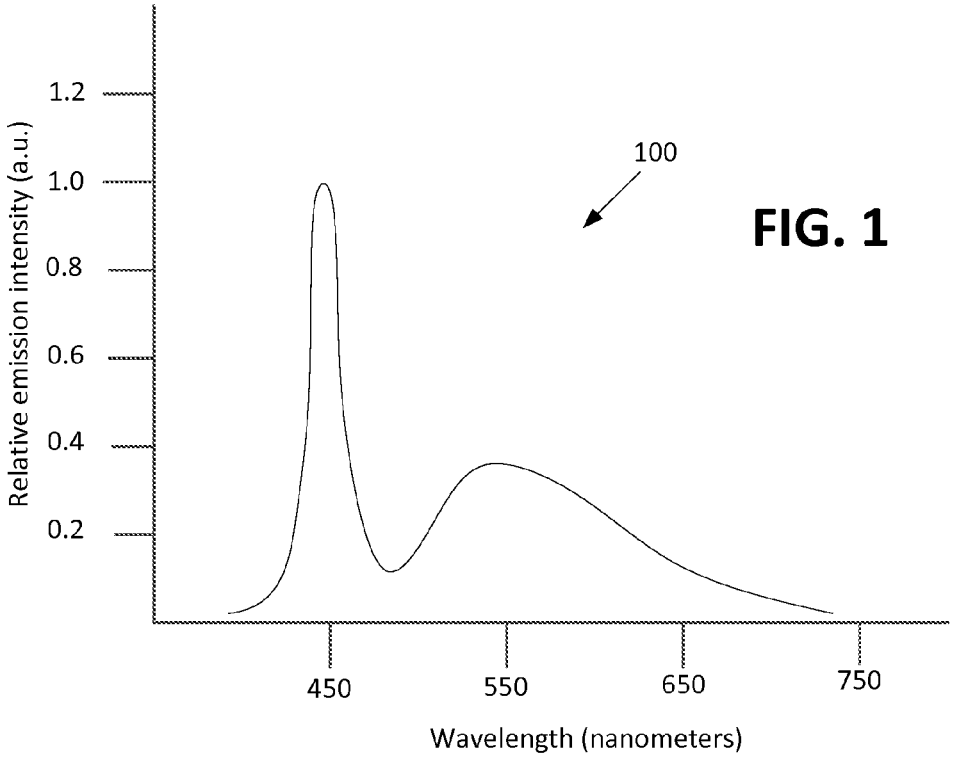
FIG. 1 is a schematic diagram of a spectrum of light emitted from a light source that includes an LED and a pumped light source.

FIG. 1 is a schematic diagram of a spectrum of light 100 emitted from a light source that includes an LED and a pumped light source (e.g., a phosphor material) that absorbs the narrowband light from the LED and emits another, typically broader, spectrum of light. In particular, FIG. 1 shows the spectrum of light after light emitted from an LED has passed through a phosphor material that absorbs some of the light from the LED and converts the absorbed light into light that is emitted from the phosphor material with a longer wavelength than the light emitted from the LED. The spectrum is represented by a curve 102 showing the relative emission intensity of light as a function of wavelength of the emitted light. Inorganic phosphor materials, as well as organic phosphor materials, can be used as the pump material of the pumped light source. Quantum dot semiconductor material, i.e., nanometer-size bits of semiconductor material, such as cadmium selenide, that fluoresce when excited by photons also can be used as the pumped light source. By selecting the particular materials and size of the quantum dot material, the wavelength of light emitted from the quantum dot material can be precisely tuned over a narrow range of wavelengths. In general, a quantum dot that is approximately two nanometers in diameter emits blue light, a four nanometer diameter dot emits green light, and a six nanometer diameter dot emits red light.

In the example shown in FIG. 1 the spectrum 102 has a first peak emission wavelength of about 450 nm, where the first peak has a full width at half maximum (FWHM) bandwidth of about 20 nm. Such a peak in the spectrum 102 is characteristic of blue light that would be emitted from an LED and which would pass though the phosphor material without being absorbed and re-emitted by the phosphor material. The example spectrum 102 also has a second peak emission wavelength of about 550 nm, where the second peak has a full width at FWHM bandwidth of about 100 nm. Such a peak in the spectrum is characteristic of light that would be emitted from the phosphor material after the blue light from the LED had been absorbed by the phosphor material and re-emitted by the phosphor material and has significant intensity in the green, yellow, and red portions of the spectrum. The LED-characteristic spectrum and the phosphor-characteristic spectrum that are shown in FIG. 1 overlap, such that the relative emission intensity does not go to zero between the peaks. However, in other implementations the spectrum of the LED light and the spectrum of the pumped light source need not overlap.

By controlling the peak emission wavelengths, spectral bandwidths, and relative emission intensities of the first and second peaks and the overall shape of curve 102, the color of light emitted from the combination of the LED and the pumped material can be controlled to have a desired chromaticity coordinate that is appropriate for a particular use. For example, when used as a light source 106 for a backlit liquid crystal display (LCD) device the chromaticity coordinate can be chosen to be close to some standard white point. The overall shape of the curve 102 can be determined by controlling the physical properties of the LED and the pumped material and by controlling the electrical power supplied to the different LED. It is understood that the wavelength and FWHM bandwidth parameter values detailed herein are for illustrative purposes only, and that implementations using other wavelengths and bandwidth values are also contemplated. In particular, white light can be created from two different LEDs that have different peak emission wavelengths than described herein and from one or more phosphor materials or other pumped light sources (e.g., a quantum dot material) that emit light with a different peak emission wavelength and FWHM bandwidth than described herein. Generally, spectra of light emitted from an LED have a FWHM bandwidth of less than about 40 nm and the spectra of light emitted from a phosphor material have a FWHM bandwidth of greater than about 80 nm.

Figure 2:
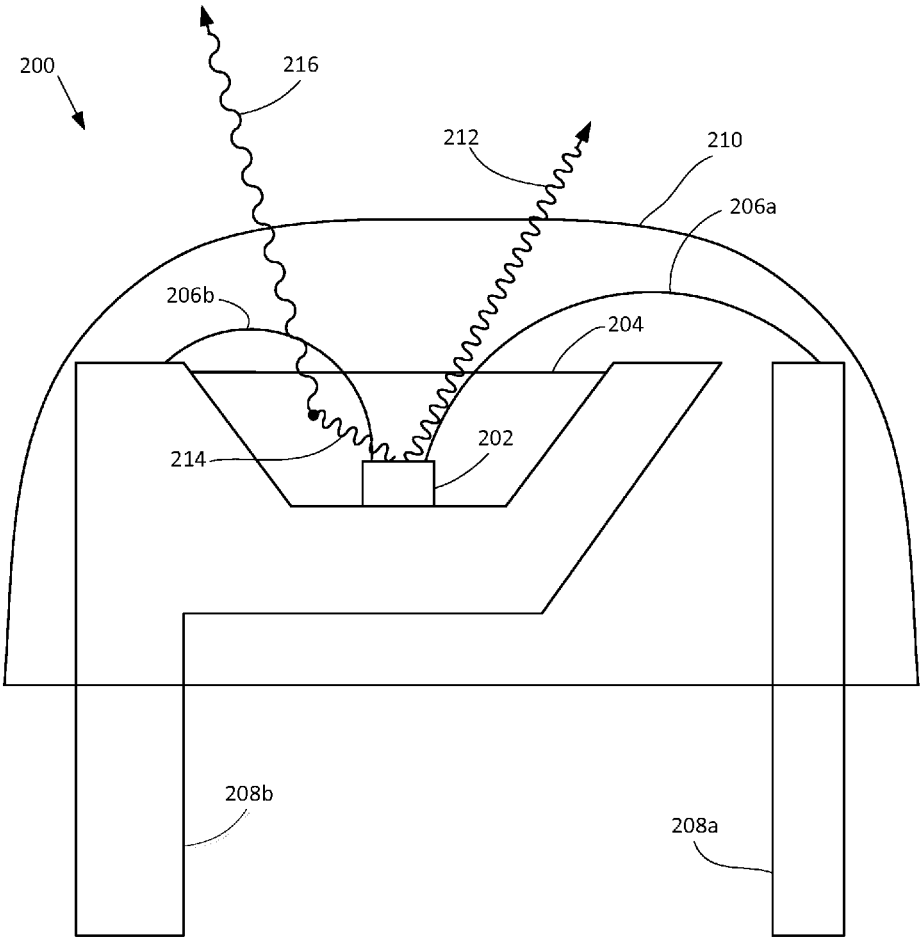
FIG. 2 is a schematic diagram of a light source that includes an LED and a phosphor material.

FIG. 2 is a schematic diagram of a light source 200 that includes an LED 202 and a phosphor material 204. The LED 202 receives electrical current through bond wires 206*a* and 206*b* that are, in turn, connected to electrical contacts 208*a* and 208*b*. The LED 202 and phosphor material 204 can be encapsulated by an encapsulation material 210. In some implementations, encapsulation material can focus the light emitted by the LED and the phosphor material in a desired direction.

The electrical power supplied to the LED 202 is converted into light that is emitted from the LED 202 and which generally has a FWHM bandwidth of less than about 40 nm. The light emitted from the LED 202 is emitted outward from the LED into the phosphor material, and some of the emitted light passes through the phosphor material 204 without being absorbed by the phosphor material 204. An example path 212 of a photon of such light is shown, where a wavy line is used to indicate a relative wavelength of the photon. Some light emitted by the LED 202 is absorbed by the phosphor material and is converted into light that is then emitted from the phosphor material. An example path 214 of a photon of light that is emitted from the LED and then is absorbed is shown. An example path 216 of a photon of light that is emitted from the phosphor material 204 after a photon from the LED 202 has been absorbed is shown. The light emitted from the phosphor material 204 has a longer wavelength than the light that is emitted from the LED 202 and generally has a FWHM bandwidth of greater than about 80 nm.

Although the phosphor material 204 is shown in FIG. 2 as encapsulating the LED 202, the phosphor material may be located elsewhere as well. For example, the phosphor material 204 can be placed directly on the emitting surface of the LED 202, or the phosphor material 204 can be disposed remotely from the LED 202 in the encapsulation material 210. In another implementation the phosphor material 204 can be disposed remotely from the LED in an optical path between the LED and a viewer. For example, the phosphor material 204 can be disposed in elements of an LCD device 100, such as, for example, in a light guide plate or in a diffuser, as described in more details below.

Figure 3:
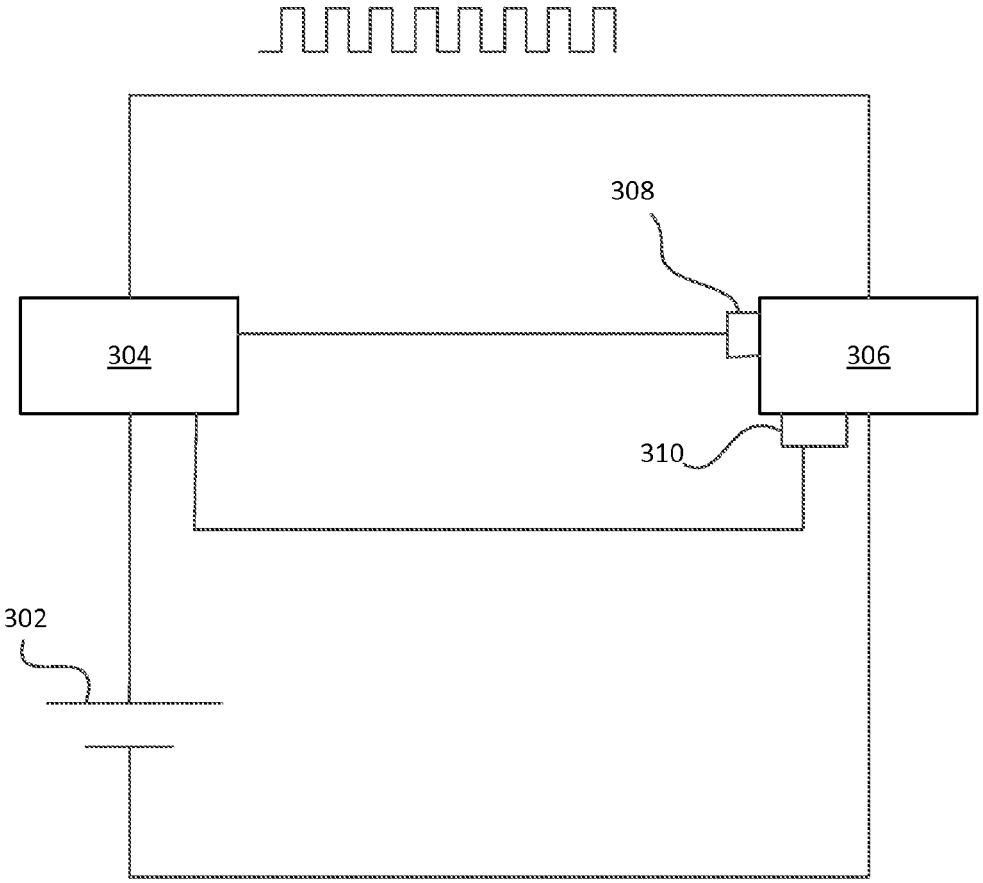
FIG. 3 is a schematic diagram of a system for controlling the emission spectrum emitted from the light source of FIG. 2.

FIG. 3 is a schematic diagram of a system 300 for controlling the emission spectrum emitted from the light source of FIG. 2. The system includes a power source 302 and control circuitry 304 for controlling the electrical power that is supplied to a LED light source 306, where the light source includes pumped material (e.g., a phosphor material) that absorbs LED light and emits light having a longer wavelength than the absorbed LED light. The LED light source 306 emits light in response to receiving electrical current from the power source 302. The system 300 can also include a temperature sensor 300 configured to monitor a temperature of the light source 306 and a cooling and/or heating device 310 configured to raise or lower a temperature of the light source 306.

The control circuitry 304 can include circuitry to vary the amount of electrical current that is supplied to the LED of the light source 306. For example, the control circuitry 304 can modulate the electrical current that is supplied by the power supply 302, such that a series of electrical pulses supplied to the LED. The control circuitry 304 can control the amplitude and duration of individual pulses in the series and can control the frequency of pulses in the series. Thus, the control circuitry can control the "duty cycle" with which electrical current is supplied to the LED, where the duty cycle can provide an indication of the percentage of time that electrical power is supplied to the LED when measured over a time period that includes many pulses. In addition, the control circuitry can control the amplitude of current pulses that are supplied to the LED.

Figure 4:
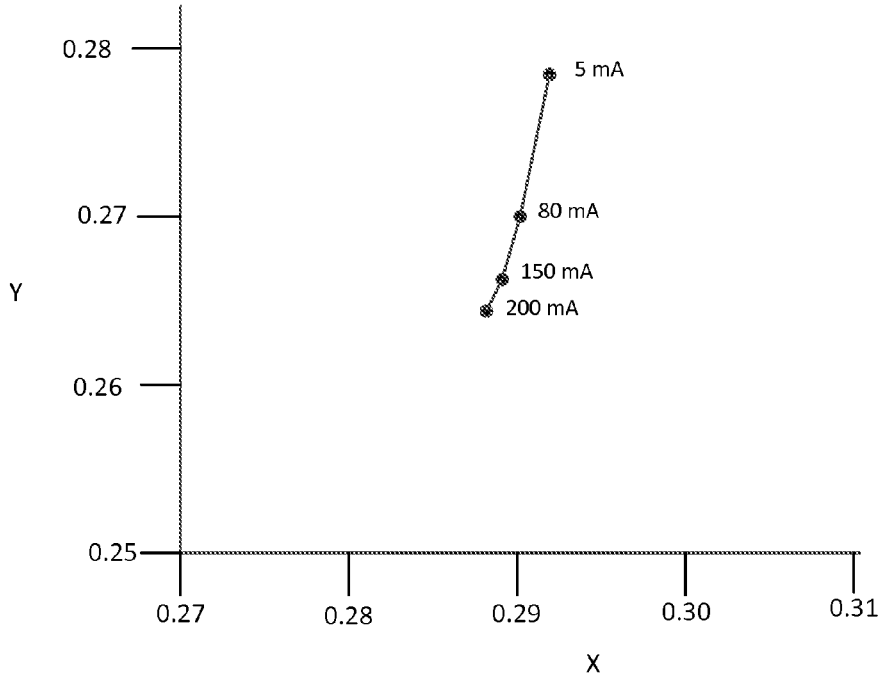
FIG. 4 is a schematic diagram of a graph showing a relationship between a two-dimensional chromaticity coordinate of light emitted from an LED light source as a function of electrical current amplitude supplied to the LED of the light source.

FIG. 4 is a schematic diagram of a graph 400 showing a relationship between a two-dimensional chromaticity coordinate of light emitted from the LED light source 306 as a function of electrical current amplitude supplied to the LED of the light source. The x-axis of the graph 400 shows the "X" chromaticity coordinate, and the Y axis of the graph 400 shows the "Y" chromaticity coordinate. Points in the graph 400 show the X and Y values of the chromaticity coordinate for different electrical current amplitude when the LED is held at a fixed temperature. For example, when the LED is supplied with 5 mA of electrical current the X, Y chromaticity coordinate of light emitted from the light source is equal to approximately 0.292, 0.277 and when 200 mA of current is supplied to the LED the X, Y chromaticity coordinate is equal to approximately 0.288, 0.265.

The shift in the chromaticity coordinate as a function of current supplied to the LED can be due to a variety of reasons. For example, higher electrical currents supplied to the LED can cause the LED to emit higher intensity light, and the higher intensity light emitted from the LED can saturate the response of the phosphor material that absorbs the light from the LED and emits longer wavelength light. Thus, the intensity of light emitted from the phosphor material may not scale proportionally with the intensity of light emitted from the native LED, such that at higher currents the proportion of shorter wavelength light emitted from the LED light source is greater than at lower currents. The LED light source 306 can be fabricated to accentuate or diminish this effect. For example, the thickness of the layer of phosphor material can be selected to provide a greater or lesser variation in chromaticity coordinate as a function of current amplitude.

Returning to FIG. 3, the control circuitry 304 can be used to control the chromaticity coordinate of the light emitted from the light source 306 by controlling the current input to the LED of the light source. For example, the control circuitry can output can output a series of current pulses, where the amplitude, frequency, and duty cycle of the pulses (e.g., the duration of the individual pulses relative to the frequency of the pulses in the series) are selected to result in a predetermined chromaticity coordinate of light emitted from the light source 306. The frequency of the current pulses can be selected such that the light emitted from the light source 306 is perceived by user to have a constant, time-averaged intensity. Of course, the light emitted from the light source 306 can have variations in the intensity due to the current pulses but if the frequency of the current pulses is high enough (e.g., greater than 20 Hz), then the human eye will not be able to detect the variations in the light intensity.

To control the chromaticity coordinate of the light from the light source 306, the control circuitry 304 can control the amplitude of the current pulses. In one implementation, the control circuitry 304 can output a series of high amplitude, low duty cycle current pulses, which result in a chromaticity coordinate with relatively low X and Y values. In another implementation the control circuitry 304 can output a series of low amplitude, high duty cycle current pulses, which resulted in a chromaticity coordinate relatively high X and Y values. By varying the current amplitude along with the duty cycle, the control circuitry 304 can cause the light source 306 to emit light that has different chromaticity coordinates but whose time-averaged luminosity is relatively constant from the perspective of a human viewer. The time-averaged luminosity can be averaged over a timescale that is relevant for a human viewer. For example, the chromaticity coordinate and the luminosity can be averaged over a timescale of more than a second.

The control circuitry 304 can control the output of the LED light source 306 to change the time-averaged chromaticity coordinate of the light emitted by the light source 306 a first time to different time-averaged chromaticity coordinate a second time. While changing the chromaticity coordinate of the light, the control circuitry 304 can simultaneously control the luminosity of the LED light source to maintain the time-averaged luminosity of the light emitted from the light source 306, while the chromaticity coordinate is changed. For example, the control circuitry 304 can first provide a series of current pulses having high amplitude and a low duty cycle to the LED of the light source 306, so that the light source produces relatively blue light. Then, to control circuitry 304 can provide current pulses having a low amplitude and a high duty cycle, so that the light source produces relatively red light. While the control circuitry 304 changes the amplitude and duty cycle of the series of pulses, the control circuitry can also maintain the time-averaged luminosity from the light source.

The time-averaged intensity of light emitted from the LED light source can depend on the current amplitude supplied to the light source and also on the duty cycle of pulses provided to the light source. In some cases, the intensity of the light can be linearly or proportionally related to the current amplitude and/or the duty cycle of pulses, but in other cases the intensity of the emitted light can be non-linearly or non-proportionally related to the current amplitude and/or the duty cycle. Based on the known relationship between the luminosity of emitted light and the input current amplitude duty cycle of current pulses, the control circuitry 304 can maintain the time averaged luminosity while changing the chromaticity coordinate of the emitted light.

Actively controlling the relative amount of power supplied to each LED light source 306 and 308 to control the chromaticity coordinate of the combined output of the two sources 306 and 308 can be advantageous because the tolerances on the performance parameters of the sources 306 and 308 can be relatively relaxed when choosing individual sources 306 and 308 to use to produce a white light source 106. In other words, because controlling the relative amount of power supplied to each LED light source 306, 306 can be used to shift the chromaticity coordinate of the combined output of the two sources 306 and 308, when choosing many individual devices to use in one or more products, each source 306 need not perform exactly like every other source 306, and each source 308 need not perform exactly like every other source 308, since the active control of the power input to the sources can compensate somewhat for performance deviations in the individual devices.

Figure 5:
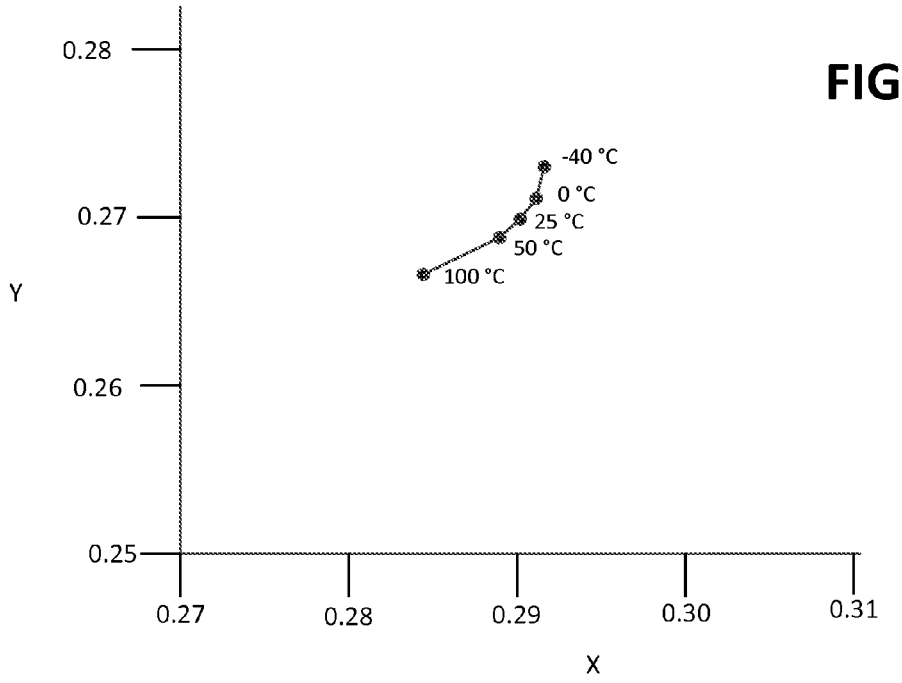
FIG. 5 is a schematic diagram of a graph showing a relationship between a two-dimensional chromaticity coordinate of light emitted from an LED light source as a function of a temperature of the LED of the light source.

FIG. 5 is a schematic diagram of a graph 500 showing a relationship between a two-dimensional chromaticity coordinate of light emitted from the LED light source 306 as a function of a temperature of the LED of the light source. The x-axis of the graph 500 shows the "X" chromaticity coordinate, and the Y axis of the graph 500 shows the "Y" chromaticity coordinate. Points in the graph 500 show the X and Y values of the chromaticity coordinate for different temperatures when the LED is supplied with a fixed current (e.g., 80 mA). For example, when the LED is held at −40° C. the X, Y chromaticity coordinate of light emitted from the light source is equal to approximately 0.292, 0.274 and when the LED is held at 100° C. the X, Y chromaticity coordinate is equal to approximately 0.284, 0.265.

The shift in the chromaticity coordinate as a function of the temperature of the LED can be due to a variety of reasons. For example, increasing temperature of the semiconductor material of the LED can increase the lattice constant of the semiconductor material due to thermal expansion, which in turn decreases the bandgap of the material, and the lower bandgap of the material can result in a longer wavelength of the output light. The intensity of light emitted by an LED can also vary with the temperature of the LED. Generally, for fixed input current, the LED will emit higher intensity light at lower temperatures than at higher temperatures. However, the intensity of light emitted from the LED may not scale proportionally with the temperature of the LED.

Referring again to FIG. 3, the temperature dependence of the chromaticity coordinate of the light source also can be exploited to control the chromaticity coordinate of the light source. For example, the heating/cooling device 310 can be utilized to control the temperature of the light source, in particular to control the temperature of the LED in the light source 306. The heating/cooling device 310 can include a cooling element, which may include a fan, or a thermoelectric cooler (e.g., a Peltier cooler), or another device that lowers the temperature of the LED. The device 310 can also include a heating element, which may include a resistive heater or another device that increases the temperature of the LED in the light source 306. The temperature sensor 308 coupled to the light source 306 can send the temperature of the light source and provide feedback to the control circuitry 304 so that the control circuitry can adjust the heating/cooling device 310 to maintain the light source 306 at a desired temperature.

LED light sources that emit white light can be used in a variety of applications, including, for example, with liquid crystal display (LCD) devices that can be used in applications such as in televisions, computer monitor display devices, tablet display devices, mobile phone and smart phone displays. LCDs are energy efficient when compared with other types of displays, and they can be thinner than many other types of displays. Most LCDs include a layer of liquid crystal molecules aligned between two transparent electrodes, and two polarizing filters whose axis of transmission are perpendicular to each other. A source of light is provided to the LCD, and the amount of light that passes through the LCD can be controlled by controlling an electric field between the two transparent electrodes, which, in turn, controls the orientation of the liquid crystal molecules and therefore the amount of light that passes through the LCD.

An LCD device can include many individually-controllable pixel elements. By controlling the amount of light that is transmitted through each element an image can be defined by the LCD device. In addition, the pixel elements may include multiple different color filters, where the amount of white light passing through each filter can be individually-controlled, so that the LCD device can render a color image.

Figure 6:
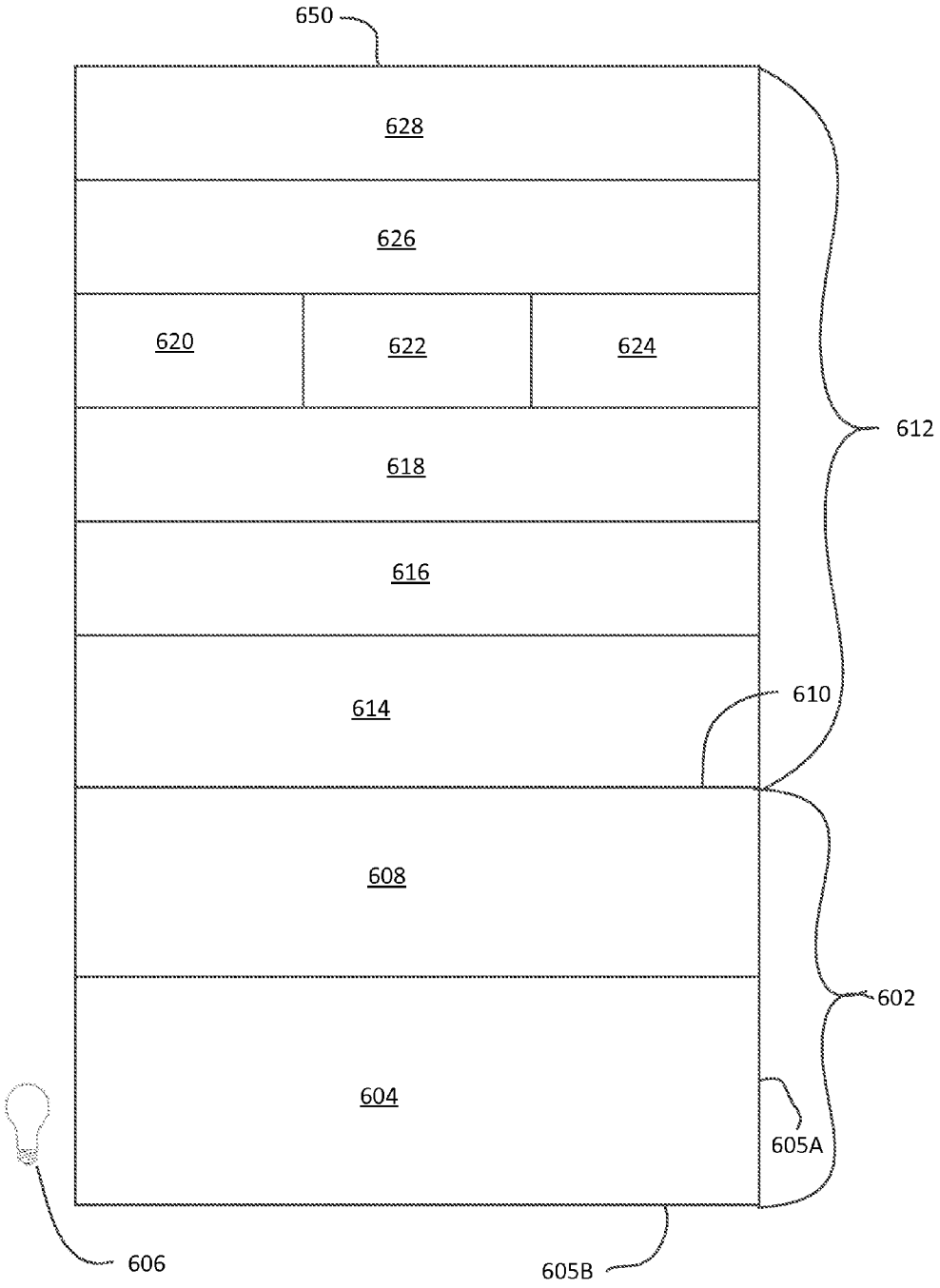
FIG. 6 is an example cross-sectional schematic diagram of a pixel element of a liquid crystal display.

FIG. 6 is an example cross-sectional schematic diagram of pixel element of an LCD device 600. The pixel element can include a backlight section 602 and an LCD section 612. The backlight section 602, can include a transparent light guide panel (LGP) 604 that can include glass, plastic, polymer, etc. material, which can transmit or guide light from an edge- or rear-mounted light source 606. In the example implementation shown in FIG. 6, the light source 606 is edge-mounted, in that the light source is mounted proximate to an edge of the LGP 606, so that the light from the source 606 is coupled into the LGP 604 through an edge of the LGP and can traverse the LGP to a side surface LGP which can include a reflecting surface to re-inject light into the LGP 604. Light can also strike a bottom surface 605B of the LGP, where the bottom surface 605B can include a reflecting surface to re-direct light into the LGP 604. In an example back-lit implementation (not shown), the light source 606 can be mounted proximate to the bottom surface 605B of the LGP 604 and coupled through the bottom surface into the LGP. In the backlit implementation both side surfaces of the LGP can include reflecting surfaces to redirect light into the LGP 604.

The LGP 604 is coupled to a diffuser 608 that extracts light from the LGP and directs the light toward the display surface 650 of the LCD pixel element 600. The interface surface 610 of the LGP 604 and the diffuser 608 can be roughened, pitted, dimpled, etc., where the surface features are defined on a scale that is selected to scatter light in the LGP 604 out of the LGP and into the diffuser 608. The bottom surface 605B of the LGP 604 also can be similarly roughened, pitted, dimpled, etc., to scatter light in the LGP 604 out of the LGP and into the diffuser 608. The diffuser 608 includes transparent material that transmits light to the LCD section 612. The diffuser 608 can include a multi-layered optical film stack that includes a diffusing layer, prisms and other optical elements that control the light to create a substantially homogeneous intensity profile over the display surface 650 of the pixel element 600.

The LCD section 612 can include a rear polarizer 614, an addressing structure 616 that may include thin film transistors (TFTs) disposed on a transparent plate, a liquid crystal material layer 618, color filters (e.g., red, green, and blue filters) 620, 622, 624 on a transparent plate, a front polarizer 626, and a protective glass layer 628.

As light traverses, and reflects within, the LGP 604, it can be scattered from the interface 610 of the LGP 604 and the diffuser 608, such that light enters the diffuser and propagates upward though the pixel element 600. Light that passes through the diffuser is polarized by the rear polarizer 614 and then enters the liquid crystal material layer 618. The TFTs in the addressing structure 616 control the amount of charge between different regions of the addressing structure 616 and the color filters 620, 622, 624, and the amount of charge determines the degree to which long molecules in the liquid crystal material layer 616 are oriented in such a manner as to act as a selective polarization region that, in conjunction with rear polarizer 614 prevents light from reaching one or more of the color filters 620, 622, 624. In this way, the amount of light that is allowed to pass into the individual color filters 620, 622, 624 is controlled. The color filters 620, 622, 624 filter the light passing through them, and the light is then repolarized by the front polarizer 626 and passes though the cover glass 628 of the display.

The light source 606 can include one or more LEDs that emit white light. White LEDs can be LEDs that natively emit light primarily in the blue end of the color spectrum but which are coated with a phosphor material, such that the light emitted from the phosphor-coated LED is a broad-spectrum white color. In another implementation, the light source 606 can include multiple LEDs that emit light at different wavelengths (e.g., red, green, and blue).

Figure 7:
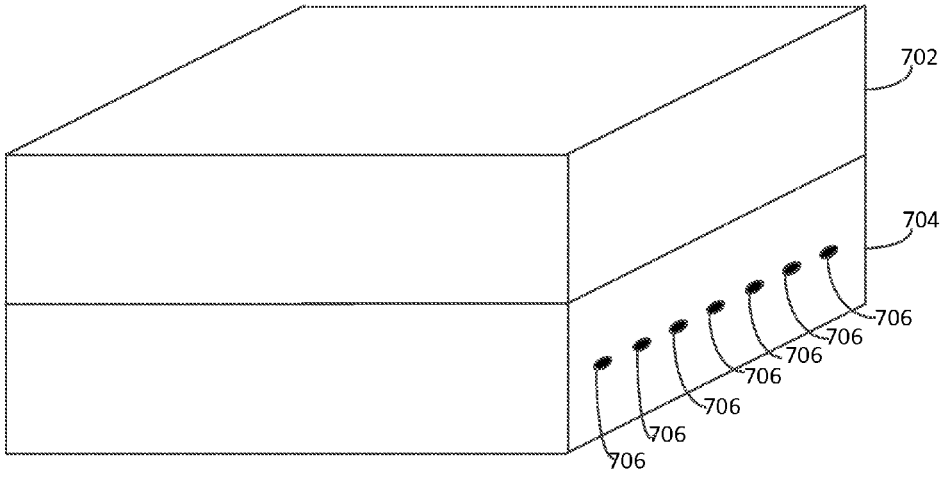
FIG. 7 is a schematic perspective view of a light guide panel and a diffuser.

FIG. 7 is a schematic perspective view of the LGP 604 and the diffuser 608. Multiple light sources 606 can be positioned at an edge of the LGP 604, so that light emitted from the sources enters the LGP. As the light propagates through the LGP 604, most of the light is coupled upward into the diffuser 608, so that it can be used to illuminate the LCD portion 612 of the device. The multiple light sources can be mounted on one or more printed circuit boards (PCB), as discussed below.

Figure 8:
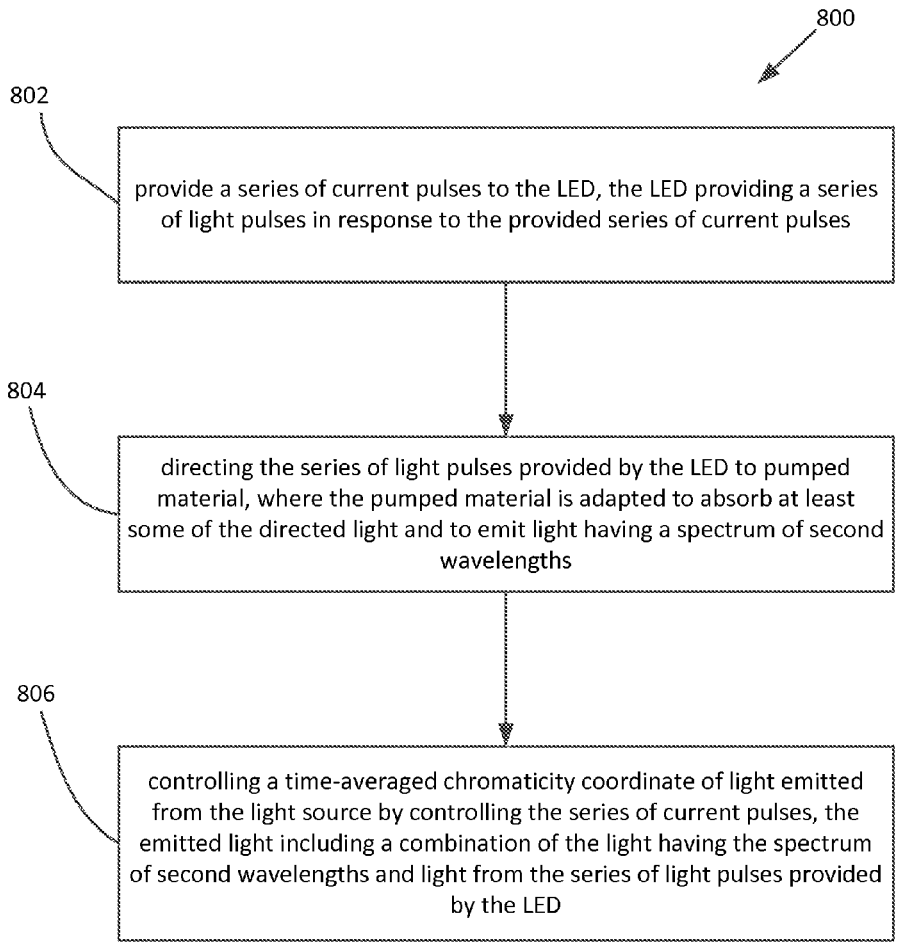
FIG. 8 is a flow chart of a process for controlling a color of light from a light source that includes an LED and a pumped material.

FIG. 8 is a flow chart of a process 800 for controlling a color of light from a light source that includes an LED and a pumped material. A series of current pulses is provided to the LEDs (802), and the LED provides a series of light pulses in response to the provided series of current pulses. The series of light pulses provided by the LED is directed to the pump material (804), and the pump material that constitutes or at least some of the direct light into the light having spectrum of second wavelengths. A time averaged chromaticity coordinate of light emitted from the light source is controlled by controlling the series of current pulses (806), where the emitted white include combination of light having spectrum of second wavelengths and light from the series of light pulses provided by the LED.

Implementations can include one or more the following features. For example, the pumped material can be a phosphor material, and the LED can be at least partially encapsulated by the pumped material. A time-averaged luminosity of the light emitted from the light source can be maintained only time averaged chromaticity coordinate is controlled. Controlling the series of current pulses can include controlling a duration of the current pulses in the series of current pulses. Controlling the series of current pulses can control your frequency at which the current pulses are provided to the LEDs, and the frequency at which the current pulses are provided to the LED can be greater than 5 Hz. Controlling the series of current pulses can include controlling amplitude of the current pulses.

Controlling the time averaged chromaticity coordinate of light emitted from the light source can further include controlling a temperature of the LED. The time-averaged chromaticity coordinate of light emitted from the light source can be averaged over time more than one second. A peak emission wavelength of light pulses provided by the LEDs can be between 440 nm 500 nm, and the spectrum of second wavelengths can have a peak emission wavelength of between 570 nm and 610 nm.

The process 800 can include changing the time averaged chromaticity coordinate of light produced by the light source at a first time to a different time averaged chromaticity coordinate by controlling the series of current pulses while maintaining a time averaged luminosity of the light emitted from the light source while the time averaged chromaticity coordinate is controlled. The light emitted by the light source can be provided to a light guide panel that is coupled to a computer-controlled display device, where the light guide panel is configured to transmit the emitted light to be computer controlled display device.

Implementations of the various techniques described herein may be implemented in digital electronic circuitry, or in computer hardware, firmware, software, or in combinations of them. Implementations may be implemented as a computer program product, i.e., a computer program tangibly embodied in an information carrier, e.g., in a machine-readable storage device, for execution by, or to control the operation of, data processing apparatus, e.g., a programmable processor, a computer, or multiple computers. A computer program, such as the computer program(s) described above, can be written in any form of programming language, including compiled or interpreted languages, and can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a communication network.

Method steps may be performed by one or more programmable processors executing a computer program to perform functions by operating on input data and generating output. Method steps also may be performed by, and an apparatus may be implemented as, special purpose logic circuitry, e.g., a FPGA or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. Elements of a computer may include at least one processor for executing instructions and one or more memory devices for storing instructions and data. Generally, a computer also may include, or be operatively coupled to receive data from or transfer data to, or both, one or more mass storage devices for storing data, e.g., magnetic, magneto-optical disks, or optical disks. Information carriers suitable for embodying computer program instructions and data include all forms of non-volatile memory, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory may be supplemented by, or incorporated in special purpose logic circuitry.

To provide for interaction with a user, implementations may be implemented on a computer having a display device, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

While certain features of the described implementations have been illustrated as described herein, many modifications, substitutions, changes and equivalents will now occur to those skilled in the art. It is, therefore, to be understood that the appended claims are intended to cover all such modifications and changes as fall within the scope of the embodiments.

What is claimed is:

1. A method of controlling a color of light from a light source, the light source including an LED and a pumped material, the method comprising:

providing a series of current pulses to the LED, the LED providing a series of light pulses in response to the provided series of current pulses;

directing the series of light pulses provided by the LED to the pumped material, wherein the pumped material is adapted to absorb at least some of the directed light and to emit light having a spectrum of second wavelengths; and controlling a time-averaged chromaticity coordinate of light emitted from the light source, while maintaining the time-averaged luminosity of the light emitted from the light source, by controlling the series of current pulses and by controlling a temperature of the LED, the emitted light including a combination of the light having the spectrum of second wavelengths and light from the series of light pulses provided by the LED.

2. The method of claim 1, wherein controlling the series of current pulses includes controlling a duration of the current pulses in the series of current pulses.

3. The method of claim 1, wherein controlling the series of current pulses includes controlling a frequency at which the current pulses are provided to the LED.

4. The method of claim 1, wherein a frequency at which the current pulses are provided to the LED is greater than 5 Hz.

5. The method of claim 1, wherein controlling the series of current pulses includes controlling an amplitude of the current pulses.

6. The method of claim 1, wherein the time-averaged chromaticity coordinate of light emitted from the light source is averaged over a time of more than one second.

7. The method of claim 1, wherein a peak emission wavelength of the light pulses provided by the LED is between 440 nm and 510 nm.

8. The method of claim 1, wherein the spectrum of second wavelengths has a peak emission wavelength of between 570 nm and 610 nm.

9. The method of claim 1, wherein the LED is at least partially encapsulated by the pumped material.

10. The method of claim 1, further comprising:

changing the time-averaged chromaticity coordinate produced by the light source at a first time to a different time-averaged chromaticity coordinate produced at a second time by controlling the series of current pulses, while maintaining a time-averaged luminosity of the light emitted from the light source while the time-averaged chromaticity coordinate is controlled.

11. The method of claim 1, further comprising:

providing the light emitted from the light source to a light guide panel, the light guide panel being coupled to a computer-controlled display device and being configured to transmit the emitted light to the computer controlled display device.

12. A light source comprising:

an LED configured to emit light having a spectrum of first wavelengths when provided with electrical current;

a pumped material configured to absorb at least some of the light emitted by the LED and to emit light having a spectrum of second wavelengths;

a power supply configured to provide a series of electrical current pulses to the LED;

a current controller configured to control a time-averaged chromaticity coordinate of a combination of light emitted from the LED and the pumped material by controlling the series of current pulses provided to the LED; and a heating/cooling element coupled to the LED and configured to control the temperature of the LED, wherein the control of the temperature of the LED controls a time-averaged chromaticity coordinate of a combination of light emitted from the LED and the pumped material, while a time-averaged luminosity of the combination of light is maintained by controlling the series of current pulses provided to the LED.

13. The light source of claim 12, wherein controlling the series of current pulses includes controlling a duration of the current pulses in the series of current pulses.

14. The light source of claim 12, wherein controlling the series of current pulses includes controlling a frequency at which the current pulses are provided to the LED.

15. The light source of claim 12, wherein controlling the series of current pulses includes controlling an amplitude of the current pulses.

16. The light source of claim 12, wherein the time-averaged chromaticity coordinate of light emitted from the light source is averaged over a time of more than one second.

17. The light source of claim 12, wherein a peak emission wavelength of the light emitted by the LED is between 440 nm and 510 nm.

18. The light source of claim 12, wherein the spectrum of second wavelengths has a peak emission wavelength of between 570 nm and 610 nm.

19. The light source of claim 12, wherein the LED is at least partially encapsulated by the pumped material.

20. A system comprising:

an LED configured to emit light having a spectrum of first wavelengths when provided with electrical current;

a pumped material configured to absorb at least some of the light emitted by the LED and to emit light having a spectrum of second wavelengths;

a power supply configured to provide a series of electrical current pulses to the LED;

a current controller configured to control a time-averaged chromaticity coordinate of a combination of light emitted from the LED and the pumped material by controlling the series of current pulses provided to the LED;

a heating/cooling element coupled to the LED and configured to control the temperature of the LED, wherein the control of the temperature of the LED controls a time-averaged chromaticity coordinate of a combination of light emitted from the LED and the pumped material, while a time-averaged luminosity of the combination of light is maintained by controlling the series of current pulses provided to the LED;

a computer-controlled display device; and a light guide panel configured to receive the combination of light and to transmit the emitted light to the computer controlled display device.

* * * * *